US007803099B2

(12) United States Patent
Biraud et al.

(10) Patent No.: US 7,803,099 B2
(45) Date of Patent: Sep. 28, 2010

(54) CARTON OPENING DEVICE FOR OPENING CARTONS OF DIFFERING GEOMETRIES

(75) Inventors: Kevin Biraud, Chateauroux (FR); Pascal Martini, LePoinconnet (FR)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 96 days.

(21) Appl. No.: 12/066,637

(22) PCT Filed: Sep. 12, 2006

(86) PCT No.: PCT/US2006/035381

§ 371 (c)(1),
(2), (4) Date: Sep. 4, 2008

(87) PCT Pub. No.: WO2007/033114

PCT Pub. Date: Mar. 22, 2007

(65) Prior Publication Data

US 2009/0313957 A1 Dec. 24, 2009

(30) Foreign Application Priority Data

Sep. 12, 2006 (GB) ..... 0518563.2

(51) Int. Cl.
*B31B 1/80* (2006.01)

(52) U.S. Cl. ..... 493/313; 493/315; 493/318; 53/458; 53/468; 53/381.1; 53/564; 53/573

(58) Field of Classification Search ..... 53/458, 53/468, 381.1, 564–566, 573; 493/309, 313–319
See application file for complete search history.

(56) References Cited

U.S. PATENT DOCUMENTS

| | | | | |
|---|---|---|---|---|
| 4,578,054 | A | 3/1986 | Herrin | |
| 5,662,577 | A * | 9/1997 | Reuteler | 493/315 |
| 6,050,063 | A | 4/2000 | Ford et al. | |
| 6,383,123 | B1 | 5/2002 | Ehring et al. | |
| 7,310,925 | B2 * | 12/2007 | Monti | 53/566 |
| 7,328,561 | B2 * | 2/2008 | Fochler | 53/564 |
| 2008/0300123 | A1 * | 12/2008 | Bonnain | 493/310 |

FOREIGN PATENT DOCUMENTS

| | | |
|---|---|---|
| EP | 0 734 952 | 10/1996 |
| WO | WO 97/25246 | 7/1997 |

* cited by examiner

*Primary Examiner*—Hemant M Desai
(74) *Attorney, Agent, or Firm*—MWV Intellectual Property Group

(57) ABSTRACT

A device for opening pre-glued, pre-folded sleeves into cartons. The device includes a cam wheel (20) to which are connected one or more suction arms (22). The cam wheel can be controlled to rotated at different angular velocities. A first angular velocity allows sleeves comprising a certain number of panels to be opened, and a second angular velocity allows sleeves of a different number of panels to be opened.

17 Claims, 4 Drawing Sheets

CARTON OPENING DEVICE FOR OPENING CARTONS OF DIFFERING GEOMETRIES

FIELD OF INVENTION

The present invention relates to a device for the opening of pre-glued, pre-folded sleeves into cartons and more specifically, though not exclusively, to a device that includes a variable path cam, and more particularly still, though not exclusively, a variable path cam that has a controllable angular velocity.

BACKGROUND OF INVENTION

It is known, in the field of packaging machine technology, for the opening of a pre-glued, pre-folded sleeve into a carton to be accomplished by means of a device that includes one or more suction arms fitted to a cam mechanism. Such an arrangement permits the end of each suction arm to follow a continuous, cyclic path that enables each arm to open a carton sleeve, from a flat collapsed condition as it travels along a linear conveyance means.

The limitations of such devices are, however, that each cam is designed to direct each suction arm along a specific path. The path needs to be precise in order to avoid creasing of the carton and possibly complete failure of the opening process. Furthermore it is desirable to provide a cam assembly that is compatible with more than one geometry of sleeve since the number of panels of the sleeve have an impact on the path that any one panel takes as the sleeve is opened.

The present invention seeks to provide a device that overcomes, or at least mitigates, this limitation such that it is compatible with sleeves comprising a differing number of panels, and with different relative arrangements of the same number of panels.

SUMMARY OF INVENTION

A first aspect of the present invention provides a device for at least partially opening a sleeve into a carton, the device comprising a cam mechanism controlled to function at different angular velocities, the angular velocities including a first angular velocity for opening a first type of sleeve and a second angular velocity for opening a second type of sleeve, wherein the cam mechanism includes at least one suction arm and wherein the at least partial opening of the first type of sleeve is effected by causing the suction arm to be moved substantially normal to a plane in which the sleeve is disposed and wherein the at least partial opening of the second type of sleeve is effected by causing the suction arm to be moved both normal to the said plane and simultaneously along a vector corresponding to the motion of the sleeve in said plane which conveys the sleeve through the working reach of the cam mechanism.

Preferably, the sleeve is guided between a surface of each rotating belt and rollers, the surface of the each belt are inclined to the said plane, and wherein the motion of a part of the sleeve along the inclined belts further opens the sleeve.

Preferably, the cam wheel further comprises an internal gear and sprocket arrangement that are mechanically linked to each of the one or more suction arms, and wherein the gear and sprocket arrangement prevents the orientation of each suction arm with respect to the said plane from changing as the cam wheel rotates.

Preferably, a panel of the sleeve is retained in substantially coplanar contact with the topmost surface of the conveyance means.

Preferably, a vacuum seal is formed between one or more of the suction arms and one of the panels of the, wherein suction arm heads are located on the terminal end of one or more of the suction arms, and wherein the suction arm heads are brought into contact with the panel of the sleeve.

Alternatively, the cam mechanism comprises a cam wheel, conveyance means and a belt system, the cam wheel being controlled to function at the said different angular velocities, wherein the at least one suction arm is attached to the cam wheel, the cam wheel comprising an internal gear and sprocket arrangement that is mechanically linked to each of the one or more suction arms, and wherein the gear and sprocket arrangement prevents the orientation of each suction arm with respect to the said plane from changing as the cam wheel rotates.

Alternatively, the cam mechanism comprises a cam wheel, conveyance means and a belt system, the cam wheel being controlled to function at the said different angular velocities, the at least one suction arm being attached to the cam wheel, wherein peripheral portions of each sleeve are guided between topmost surfaces of rotating belts and rollers, the top most surface of the belts being inclined to the said plane, and wherein the motion of a part of each sleeve up the inclined belts further opens that sleeve.

A second aspect of the invention provides a packaging machine having an opening mechanism as referred to in any of the of the preceding paragraphs.

BRIEF DESCRIPTION OF FIGURES

Exemplary embodiments of the invention will now be described, by way of example only, with reference to the accompanying drawings in which.

DETAILED DESCRIPTION OF THE PREFERRED EMBODIMENT

Figure 1:
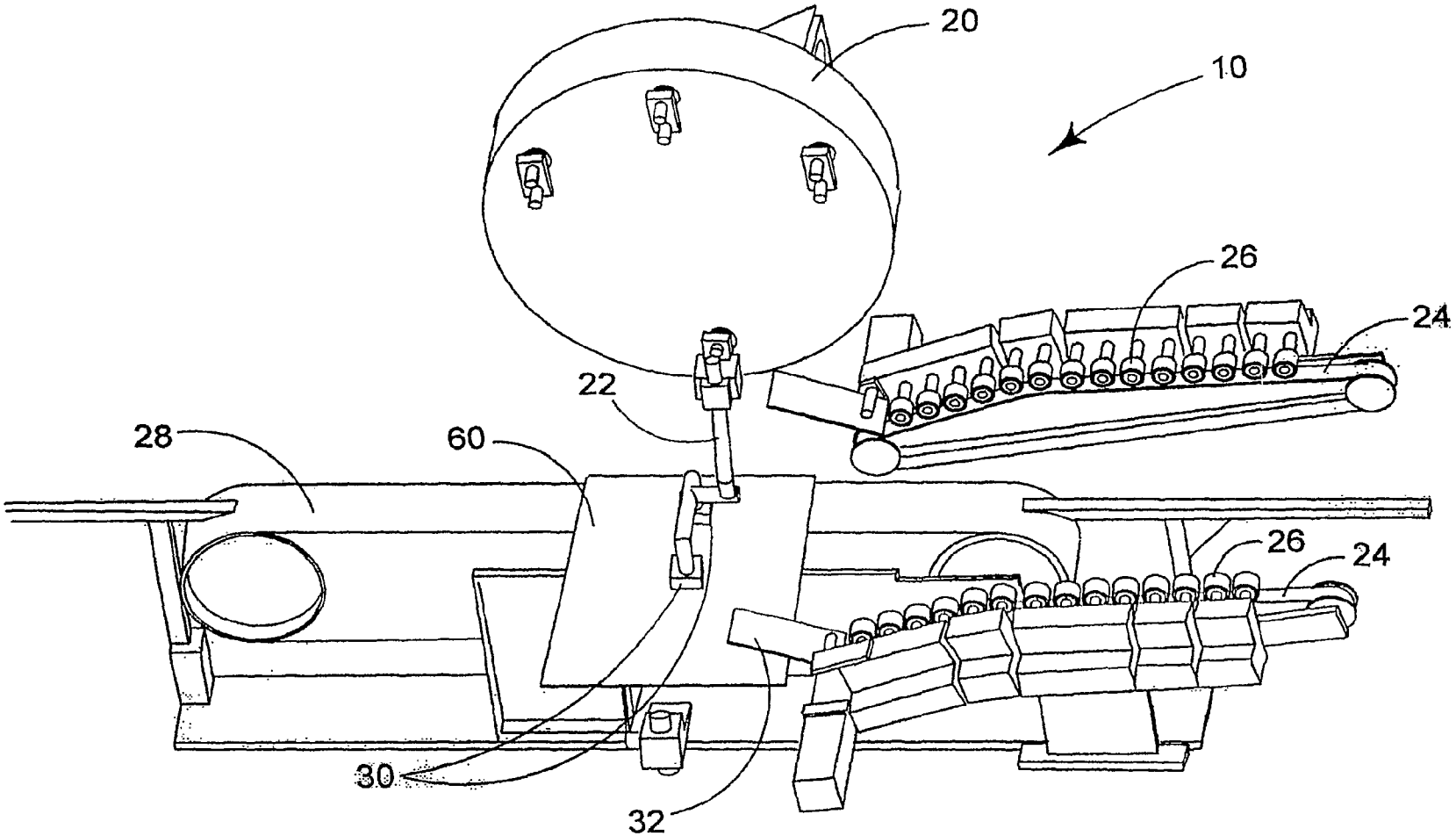
FIG. 1 illustrates 3-dimensional view of a device including a cam assembly and associated elements according to a preferred embodiment of the present invention.

FIG. 1 shows a 3-dimensional view of a device 10 including a cam wheel 20 according to a preferred embodiment of the present invention. It is envisaged that the preferred embodiment could be utilised as a carton erection device in a packaging system. FIG. 1 shows the cam wheel 20, to the front face of which may be mounted a plurality of—in this preferred embodiment, three—suction arms 22, only one of which is illustrated for enhanced clarity. Also illustrated is a sleeve 60, composed of six panels hinged one to another, intended for being opened into a carton of hexagonal cross section.

Illustrated are two suction arm heads 30, mounted on the lowermost ends of the suction arm 22 and capable of forming a vacuum seal between the suction arm 22 and a flat surface. Suction arm 22 is shown at its lowermost point at which the respective suction arm heads 30 have been brought into contact with a panel of sleeve 60, forming a vacuum seal between the suction arm 22 and the said panel. The sleeve 60 is travelling tangentially to the cam wheel 20 along a conveyance means 28. The specific arrangement and number of suction arm heads 30 are considered unessential to the core inventive concept of the present invention and may be altered from the arrangements illustrated for a preferred embodiment without parting from the spirit of the invention. This is further exemplified by the adoption of an alternative arrangement of suction head 30 in FIG. 8.

Also illustrated in FIG. 1 are belt systems 24 and a plurality of rollers 26. Each belt system 24 includes an uppermost surface that follows a two stage incline away from a plane composed of the topmost surface of the conveyance means 28. The two stage incline comprises of a first stage that is at a first angle to the plane, and a second stage that is at a second, smaller angle to the plane than the first angle. The arrangement of the rollers 26 is such that the bottommost point of the periphery of each roller 26 substantially comes into contact with the topmost surface of a respective belt 24.

The belt 24 comprises a guide 32 for accepting portions of a sleeve 60 as it moves along the conveyance means 28. Further details relating to this feature are included below.

Figure 2:
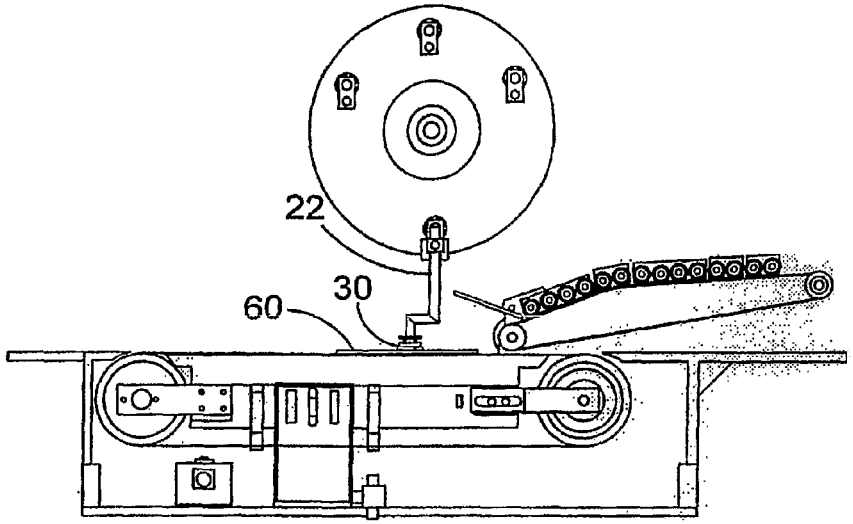
FIG. 2 illustrates a side view of the device of FIG. 1 wherein the suction arm is attached to a flat sleeve for a hexagonal carton.
Figure 3:
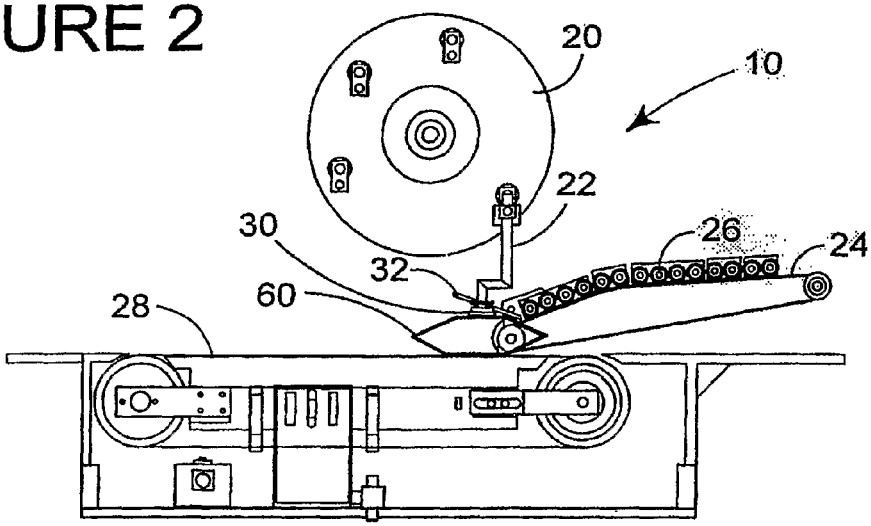
FIG. 3 illustrates a side view of the cam assembly of FIG. 1 wherein the suction arm has partially opened the sleeve for a hexagonal carton.
Figure 4:
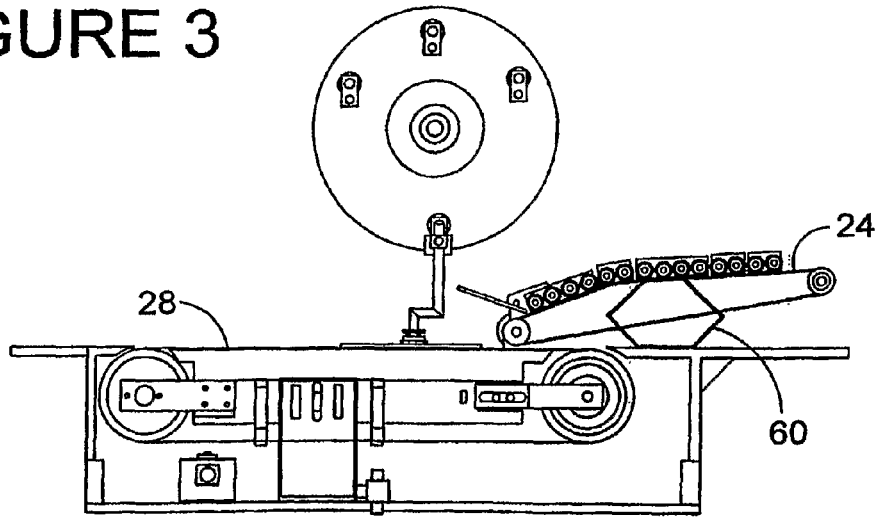
FIG. 4 illustrates a side view of the device of FIG. 1 wherein the uppermost edges of the partially opened sleeve are fed into a belt and roller assembly.

FIGS. 2, 3 and 4 illustrate three points during the process of partially opening the sleeve 60.

FIG. 2 illustrates the start point of the process, and is equivalent to the arrangement described above in relation to FIG. 1. The suction arm heads 30 have formed a vacuum seal between the suction arm 22 and a panel of sleeve 60.

FIG. 3 illustrates the device 10 after having partially opened the sleeve 60. Lower peripheral portions of the sleeve 60 are retained under rails, not shown, running along side the conveyance means 28. The lower peripheral portions are hinged to edges of another panel, forming the base of the sleeve 60, which will be lowermost after the device 10 has opened the carton. The edges of the base panel to which the lower peripheral portions are hinged are those edges that are transverse to the direction of motion of the sleeve. The presence of the rails ensures that the base panel of the sleeve 60 remains in contact with the conveyance means 28 which the suction arm partially opens the sleeve 60.

FIG. 3 further illustrates how the cam wheel 20 has rotated such that the suction arm 22 has been displaced both in the direction of the motion of the topmost surface of the conveyance means 28, and also some distance normal to the plane comprising the topmost surface of the conveyance means 28. A gearing system within the cam wheel 20 is employed to ensure that the suction arm 22 remains in the same orientation as the cam wheel 20 rotates. In this manner, the said panel, of sleeve 60, that is in contact with the suction arm heads 30, is maintained substantially parallel to a plane comprising the topmost surface of the conveyance means 28. Thus, the path of the suction arm heads 30 results in the said panel being moved away from, whilst remaining parallel to the plane comprising the topmost surface of the conveyance means 28. The design of the device 10 is such that the said panel of the sleeve 60 remains in substantial vertical alignment with a given point on the topmost surface of the conveyance means 28, whilst attached to one of the suction arms 22. The motion of the panel relative to the said given point is therefore substantially normal to the plane comprising the topmost surface of the conveyance means 28.

FIG. 3 also illustrates the point at which peripheral portions of the said panel, located along either side of the said panel transverse to the direction of motion of the topmost surface of the conveyance means 28, are guided, by guides 32, between the rollers 26 and the belts 24. The peripheral portions are hinged to the said panel and are of sufficient structural integrity that the said panel may be orientated, and the entire sleeve transported, by the incline and motion of a topmost surface of the belts 24. As the sleeve 60 is guided between the belt 24 and the rollers 26, the said panel is released from the vacuum seal with the suction arm 22.

FIG. 4 illustrates the way in which the rotary action of the belt 24 maintains the linear motion of sleeve 60 after it has reached a terminal end of conveyance means 28. The lower peripheral portions are still retained by rails, which extend beyond the terminal end of the conveyance means 28 for the full length of the belt system 24. The incline of the belt 24 achieves the effect of further separating the said panel and said another panel such that the sleeve 60 becomes increasingly opened. At the point whereby the peripheral portions of the said panel reach the terminal end of the belt the sleeve 60 is substantially fully opened and can be passed on to another device within the packaging system such as, for example, article loading apparatus.

Figure 5:
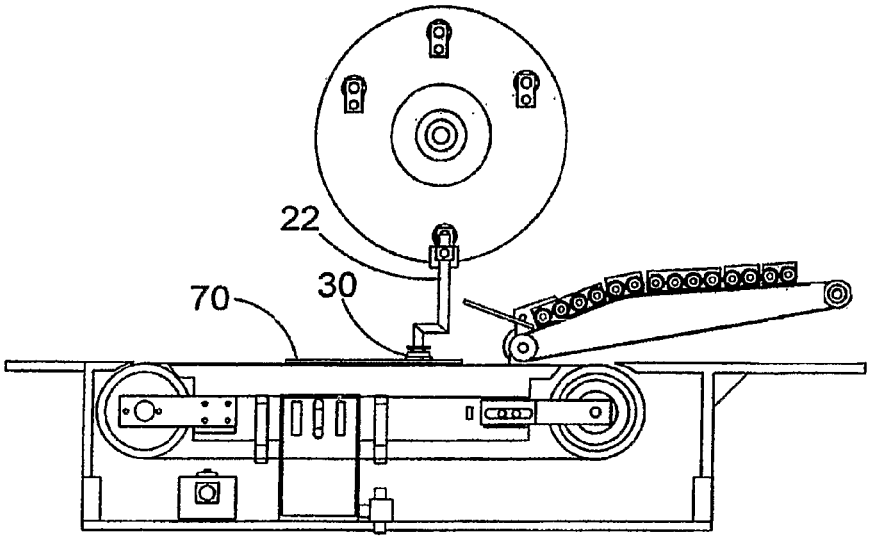
FIG. 5 illustrates a side view of the device of FIG. 1 wherein the suction arm is attached to a flat sleeve for a rectangular carton.
Figure 6:
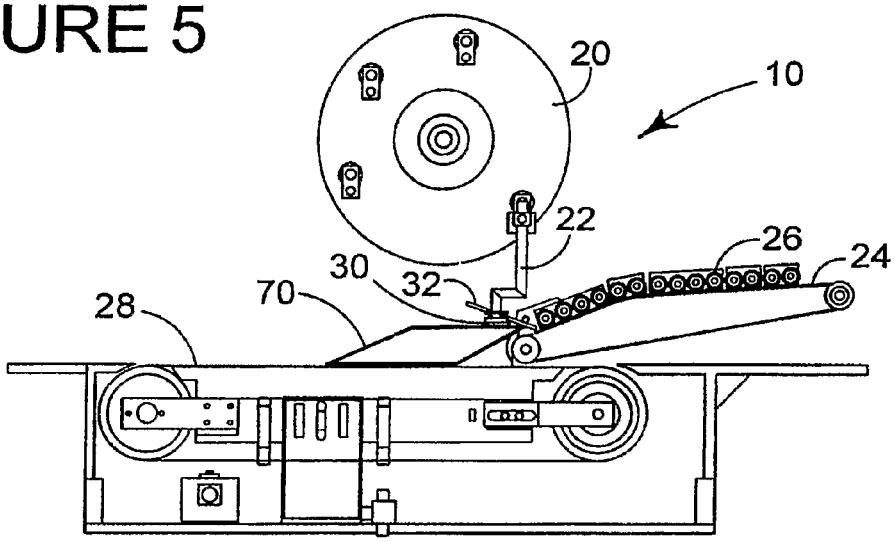
FIG. 6 illustrates a side view of the device of FIG. 1 wherein the suction arm has partially opened the sleeve for a rectangular carton.
Figure 7:
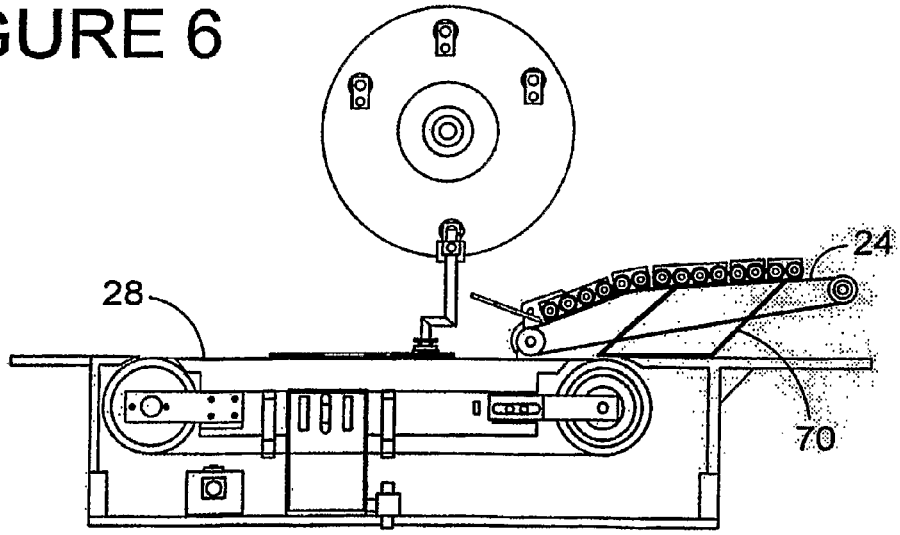
FIG. 7 illustrates a side view of the device of FIG. 1 wherein the uppermost edges of the partially opened sleeve are fed into a belt and roller assembly.

FIGS. 5, 6 and 7 illustrate three points during the process of partially opening a sleeve 70 that is formed of four panels each hinged one to the next. The geometry of sleeve 70 means that, in order to be opened into a carton of rectangular cross section, the panel with which the suction arm heads 30 form a vacuum seal is required to pass through a different path to that required in order to open sleeve 60. Such an alteration in the path is not possible by previously known devices that rely upon cam wheels. The preferred embodiment of the present invention makes such an alteration possible by employing an electrically powered cam wheel of variable rotational speed. When considering the cyclic motion of the suction arm 22 about the cam wheel 20 from a point of reference on the topmost surface of the conveyance means 28, it can be appreciated that the speed of the cam wheel 20 will effect alteration in the path of the suction arm 22 and therefore the said panel of the sleeve 70.

FIG. 5 illustrates the start point of the process. The suction arm heads 30 have formed a vacuum seal between the suction arm 22 and a panel of sleeve 70. Sue to the different in the geometry of sleeve 70 in comparison to sleeve 60, the panel with which the vacuum seal is made is in a different position to that with which a vacuum seal would have been made had the sleeve been of the geometry of sleeve 60 of FIG. 1. In the case of sleeve 70, the panel with which a vacuum seal is formed is the first of two uppermost panels to pass along the conveyance means.

FIG. 6 illustrates the device 10 after having partially opened the sleeve 70. Lower peripheral portions, or lower end closure panels, of the sleeve 70 are retained under rails running along side the conveyance means 28. The lower end closure panels are hinged to edges of a bottom panel of the sleeve 70, which will be lowermost after the device 10 has opened the carton. The presence of the rails ensures that the lowermost panel of the sleeve 70 remains in contact with the conveyance means 28 as the suction arm 22 partially opens the sleeve 70. The cam wheel 20 has rotated such that the suction arm 22 has been displaced both in the direction of the motion of the topmost surface of the conveyance means, and also some distance normal to the plane comprising the topmost surface of the conveyance means 28. A gearing system within the cam wheel 20 ensures that the suction arm remains in the same orientation as the cam wheel 20 rotates. In this manner, the panel of sleeve 70 that is in contact with the suction arm heads 30 is maintained substantially parallel to the plane of the conveyance means. Thus, the path of the suction arm heads 30 results in that panel being moved away from, whilst remaining parallel to, the plane comprising the topmost surface of the conveyance means 28. In order to partially open a carton with a configuration substantially as illustrated in FIG. 6, it is necessary for the panel in contact with the suction arm heads 30 to possess an appreciable velocity relative to a bottom panel of the sleeve 70 and in the direction of motion of the conveyance means 28. This is in contrast to the process for opening the sleeve 60 of FIG. 3 during which both the bottom panel and the panel in contact with the suction arm heads 30 are required to have the same velocity in the direction of motion of the conveyance means 28.

FIG. 6 also illustrates the point at which end closure panels, or peripheral portions of a top panel of sleeve 70, are guided, by guides 32, between the rollers 26 and the belts 24. The end closure panels are preferably hinged to the top panel of sleeve 70 and are of sufficient structural integrity that the top panel may be orientated, and the entire sleeve transported, by the incline and motion of a topmost surface of the belts 24. As the sleeve 70 is guided between the belt 24 and the rollers 26, the said panel is released from the vacuum seal with the suction arm 22.

It is advantageous that as large a proportion of the top panel (including its peripheral portions) of the sleeve are supported at the point that the vacuum seal with the suction arm 22 is released. It is therefore contemplated that a secondary belt system, parallel with the conveyance means and offset therefrom, may be provided to enhance the robustness of the above system. Such secondary belts could provide a surface upon which the aforementioned peripheral portions of the top panel may be disposed, and which could rotate to provide additional driving force for passing the peripheral portions between the roller 26 and the belts 24. A further feature of may be the provision of an articulated guide at the head of such a secondary belt system that would initially be disposed in a lowered configuration and thereby assist in raising the level of the peripheral portions and, as a result, the top panel. Once the leading edge of the top panel has passed over the articulated guides, they could be controlled to be repositioned to an elevated configuration, thereby supporting the remainder of the peripheral portions of the top panel. Additionally or alternatively, an air blower may be place proximate the start of the belts 24, and could blow a stream of air upward toward an underside of the top panel of the sleeve 70, thereby assisting to maintain the sleeve 70 in a semi erected condition as it passes between the rollers 26 and the belts 24.

FIG. 7 illustrates the way in which the rotary action of the belt 24 maintains the linear motion of the sleeve 70 after it reaches a terminal end of the conveyance means 28. The lower peripheral end closure panels of sleeve 70 are still retained by rails, which extend beyond the terminal end of the conveyance means 28 for the full length of the belt system 24. The incline of the belt 24 achieves the effect of further separating the top panel and bottom panels such that the sleeve 70 becomes increasingly opened. At the point where the sleeve 70 reaches the terminal end of the belt it is substantially in a fully opened condition, and can be passed on to another device within the packaging system such as, for example, article loading apparatus.

FIGS. 1 to 7 each illustrate only one of the suction arms 22 connected to the cam wheel 20, for enhanced clarity.

Turning to the invention in general, it will be understood that it is possible to employ multiple suction arms 22, the maximum number being determined by the size of the sleeves 60/70 and the desired throughput capacity of the device.

Figure 8:
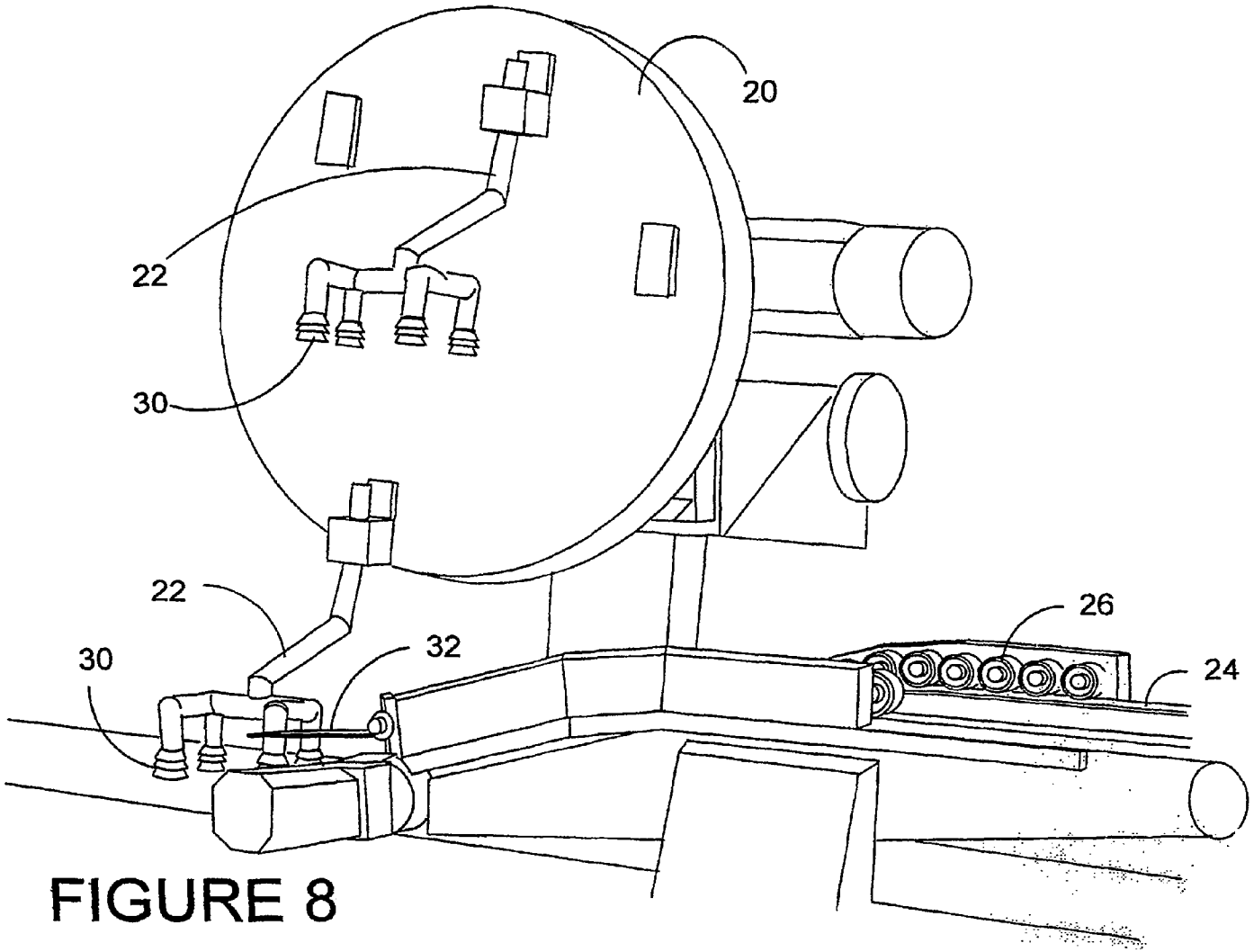
FIG. 8 illustrates the location of a second suction arm of a cam assembly according to the preferred embodiment of the present invention.

FIG. 8 illustrates a preferred embodiment of the present invention in which two suction arms 22 are controlled by cam wheel 20. It is envisaged that any number of suction arms may be employed without departing from the spirit of the invention.

It is contemplated to be within the scope of the present invention, as defined by the claims, that the device may form a sub assembly of a larger packaging machine that offers further functionality in respect of packaging articles such as cans or bottles, within the erected cartons.

References to directional features such as 'top,' 'bottom,' 'topmost,' 'uppermost' and 'lowermost' serve only to differentiate their respective components from one another, and should not be seen as limiting those respective components to a particular orientation; it will be understood that other embodiments may be used in which such directional features are altered without departing from the scope of the present invention. For example, the entire device could theoretically be mounted vertically, with suitable adjustment of the conveyance means, such that the sleeve 60/70 could no longer be described as being placed upon a topmost surface of the conveyance means; it is envisaged that such an embodiment would, however, clearly still fall within the scope of the present invention.

It will further be understood that references to "cam," "cam mechanism" and "cam wheel" are meant as illustrative descriptors only, and do not limit their respective components to any particular configuration.

The invention claimed is:

1. A device for at least partially opening a first type of sleeve having a bottom panel to form a first type of carton or a second type of sleeve having a bottom panel to form a second type of carton, as said first or second type of sleeve is disposed upon a conveyor and travels, said first or second type of sleeve has a speed and a direction of motion through a working reach of said device, said device comprising a cam mechanism that is controlled to function at different angular velocities including a first angular velocity for at least partially opening a first type of sleeve, and a second angular velocity for at least partially opening a second type of sleeve, wherein said cam mechanism comprises a suction arm that engages said first or second type of sleeve, and wherein the at least partial opening of said first type of sleeve is effected causing said suction arm to move with the same speed as said first type of sleeve in a direction substantially the same as said direction of motion of said first type of sleeve and simultaneously to move normal to said direction of motion of said first type of sleeve, and wherein the at least partial opening of the second type of sleeve is effected by causing the suction arm to be moved in a direction substantially parallel to said direction of motion of said second type of sleeve and simultaneously to move normal to said direction of motion of said second type of sleeve and wherein the suction arm moves with a velocity that is greater than that of said bottom panel of said second type of sleeve.

2. The device of claim 1, wherein said cam mechanism further comprises an internal gear and sprocket arrangement that are mechanically linked to said suction arm, and wherein said gear and sprocket arrangement maintains said suction arm in a certain, constant, orientation relative to said first or second type of sleeve.

3. The device of claim 1, wherein said first or second type of sleeve comprises a coplanar panel, which coplanar panel is retained in substantially coplanar contact with a topmost surface of said conveyor.

4. The device of claim 1, wherein said first or second type of sleeve comprises a panel and a vacuum seal is formed between said suction arm and that panel, wherein said vacuum seal is formed by a suction arm head that is located on a terminal end of said suction arm, and wherein said suction arm head is brought into contact with said panel of said sleeve.

5. The device of claim 1, wherein said cam mechanism comprises more than one such suction arm.

6. The device of claim 1, wherein said first or second type of sleeve is guided onto a surface of a rotating belt, and wherein said surface is inclined to said direction of motion of said sleeve, and wherein rotation of said rotating belt further opens said sleeve.

7. The device of claim 6, wherein said portion of said sleeve is a peripheral portion of said sleeve.

8. The device of claim 6, wherein a further conveying means is provided to maintain the sleeve in a partially opening condition as the sleeve is passed between said roller and said belt after the suction arm has been separated from said sleeve, wherein said further conveying means rotates in said direction of motion of said sleeve.

9. The device of claim 8, wherein said device further includes an articulated guide panel, positioned at a leading edge of said further conveying means and which is adapted to be controllably articulated between a lowered configuration in which the guide presents an inclined surface to said portion of said sleeve, and an erected configuration in which the guide is disposed substantially parallel to said conveying means and assists in supporting said portion as it passes onto said further conveying means.

10. The device of claim 8, wherein said device further comprises an air blower system that assists in maintaining said sleeve in a partially opened state as said portion is passed between said roller and said belt by directing an air flow toward an internal surface of said sleeve such that a resultant increased air pressure upon said surface serves to assist in maintaining said sleeve in a partially open state.

11. A packaging machine comprising an opening mechanism to enable said packaging machine of form cartons for containing cans or bottles, which opening mechanism comprises a cam mechanism that is controlled to function at different angular velocities, said angular velocities including a first angular velocity for at least partially opening a first type of sleeve having a bottom panel, and a second angular velocity for at least partially opening a second type of sleeve having a bottom panel, wherein said cam mechanism comprises a suction arm that engages said sleeve, and wherein at least partial opening of said first type of sleeve is effected causing said suction arm to move with the same speed as said first type of sleeve in a direction substantially the same as said direction of motion of said first type of sleeve and simultaneously to move normal to said direction of motion of said first type of sleeve and wherein said suction arm possesses an appreciable velocity relative to said bottom panel of said first type of sleeve, and wherein at least partial opening of said second type of sleeve is effected by causing said suction arm to be moved in a direction substantially parallel to said direction of motion of said second type of sleeve and simultaneously to move normal to said direction of motion of said second type of sleeve and wherein said suction arm moves with a velocity that is greater than that of said bottom panel of said second type of sleeve.

12. The packaging machine of claim 11, wherein said cam mechanism further comprises an internal gear and sprocket arrangement that are mechanically linked to said suction arm, and wherein said gear and sprocket arrangement maintains said suction arm in certain, constant, orientation relative to said first or second type of sleeve.

13. The packaging machine of claim 11, wherein said one or both of said first or second type of sleeve comprises a panel, which panel is retained in substantially coplanar contact with a topmost surface of said conveyor.

14. The packaging machine of claim 11, wherein one or both of said sleeves comprises a panel and a vacuum seal is formed between said suction arm and that panel, wherein said seal is formed between that panel and a suction arm head that is located on a terminal end of said suction arm, and wherein said suction arm head is brought into contact with that panel of said sleeve.

15. The packaging machine of claim 11, wherein one or both of said sleeves is guided onto a surface of a rotating belt, and wherein said surface is inclined to said direction of motion of said sleeve, and wherein rotation of said rotating belt further opens the sleeve.

16. The packaging machine of claim 15, wherein a further conveyor is provided to maintain the sleeve in a partially opening condition as the sleeve is passed between said roller and said belt after the suction arm has been separated from said sleeve, wherein said further conveying means rotates in said direction of motion of said sleeve.

17. The packaging machine of claim 16, wherein said device further includes an articulated guide panel, positioned at a leading edge of said further conveyor and which is adapted to be controllably articulated between a lowered configuration in which the guide presents an inclined surface to said portion of said sleeve, and an erected configuration in which the guide is disposed substantially parallel to said conveying means and assists in supporting said portion as it passes onto said further conveyor.

* * * * *